United States Patent [19]

Fyfe et al.

[11] Patent Number: 4,617,769

[45] Date of Patent: Oct. 21, 1986

[54] ASEISMIC BEARING FOR BRIDGE STRUCTURES

[76] Inventors: Edward R. Fyfe, 3058 Eva Drive, Burlington, Ontario, Canada; William M. Slater, 21 Garfield Ave., Toronto, Ontario, Canada, M4T 1E6; Ronald J. Watson, 199 Sherbrooke, Williamsville, N.Y. 14221

[21] Appl. No.: 583,542

[22] Filed: Feb. 24, 1984

[51] Int. Cl.[4] ..... E02D 27/34

[52] U.S. Cl. ..... 52/167

[58] Field of Search ..... 52/167, 393, 403, 99, 52/98; 308/3 R; 14/16.1

[56] References Cited

U.S. PATENT DOCUMENTS

| | | | |
|---|---|---|---|
| 1,572,574 | 2/1926 | Stromborg | 52/167 |
| 1,651,411 | 12/1927 | Porter | 52/167 |
| 3,638,377 | 2/1972 | Caspe . | |
| 3,806,975 | 4/1974 | Fyfe . | |
| 3,921,240 | 11/1975 | Fyfe . | |
| 4,166,344 | 9/1979 | Ikonomou . | |
| 4,269,011 | 5/1981 | Ikonomou . | |
| 4,330,103 | 5/1982 | Thuries et al. | 52/167 X |
| 4,371,143 | 2/1983 | Ishida et al. | 52/167 X |
| 4,402,483 | 9/1983 | Kurabayashi et al. | 52/167 X |

FOREIGN PATENT DOCUMENTS

| | | | |
|---|---|---|---|
| 1044264 | 12/1978 | Canada . | |
| 1100714 | 5/1981 | Canada . | |
| 1459949 | 1/1970 | Fed. Rep. of Germany | 52/356 |

*Primary Examiner*—William F. Pate, III
*Assistant Examiner*—Creighton Smith
*Attorney, Agent, or Firm*—Jones, Tullar & Cooper

[57] ABSTRACT

An aseismic bearing is disclosed for use in a bridge structure in combination with a bridge support and/or sliding bearing. The aseismic bearing permits horizontal movement of the bridge's support to occur under the bridges superstructure while limiting the transmission of those forces to the superstructure. Also disclosed is a displacement control device for limiting relative movement between the two parts of the bridge.

11 Claims, 28 Drawing Figures

ASEISMIC BEARING FOR BRIDGE STRUCTURES

This invention relates to an aseismic (resistant to earthquake) bearing and more particularly the invention relates to an aseismic bearing for a bridge structure, constructed to reduce, or eliminate, the transmittal of seismic forces to the bridge structure, thereby to avoid serious damage of the bridge.

PRIOR ART

Background of the Invention

It is known to design building structures including multi-story building structures with modified foundations designed to isolate the building's superstructure from major ground motion during an earthquake. Essentially, in this prior art the superstructure is supported by its foundation so that during an earthquake relative, primarily horizontal, displacement is permitted between the foundation and the superstructure so that the high horizontal forces encountered during an earthquake will not be transferred to the superstructure in an amount sufficient to cause irreparable damage to, or destruction of, the superstructure.

Structures utilized to achieve this result include the apparatus disclosed in U.S. Pat. No. 3,638,377 dated Feb. 1, 1972 to M. S. Caspe, U.S. Pat. No. 4,166,344 issued Sept. 4, 1979 to A. S. Ikonomou, and U.S. Pat. No. 4,269.011 issued May 26, 1981 to Ikonomou. All of this known prior art is concerned in particular with building structures and teaches specific means for avoiding the translation to that structure of high seismic forces which if transmitted to the structure would be adequate to severely damage or destroy the structure, with serious consequences.

Bridge structures, like any other structure located in an earthquake zone, are capable of being damaged or destroyed by seismic forces, often with serious consequences. In general bridge structures, due to their nature, are constructed with bearings to both support and guide it, located between the bridge's deck or superstructure and the bridge supporting piers or foundations to permit relative movement between the two which movement occurs primarily as a result of dimensional changes in a longitudinal direction in the bridge deck caused by temperature changes, creep, shrinkage, earth and other movements. There are many known bearings utilized to permit movement of a bridge deck relative to its supporting structure. These bearings, as is well known, can take many different forms and include sliding plate bearings, pot bearings, rotatable spherical and cylindrical bearings and high load structural bearings. They can be fixed, multidirectional or unidirectional bearings. If fixed, guide bearing must also be provided. Normally, both the supporting and guiding is accommodated by one bearing. U.S. Pat. Nos. 3,921,240 and 3,806,975 exemplify some of these known bearings.

It would be highly desirable to provide those bridges located in earthquake zones with bearing structures which function to accommodate both the normal support and/or guiding function, and when necessary, seismic forces resulting from an earthquake. In particular it would be advantageous to have an aseismic bridge bearing which includes means for reducing to an acceptable extent the seismic forces and in particular the horizontal seismic forces transmitted to a bridge deck during an earthquake to thereby prevent damage to the bridge structure, or at least reduce damage, to the degree necessary to permit the bridge to remain relatively intact during the earthquake, and permit it to be readily repaired after the earthquake.

SUMMARY OF THE INVENTION

The present invention provides a bridge bearing structure capable of significantly reducing the seismic forces which would, without such a structure, be transmitted to a bridge deck during an earthquake. Specifically, in accordance with the present invention, there is provided a large sliding plate arranged, in combination with a bridge bearing, so that movement of the bridge support can occur under the superstructure during earthquakes when the bridge will be subjected to seismic forces. Relative displacement can be controlled by displacement control devices which can reduce displacement by up to 50% and which can use 3 internal elastic materials for different energy absorptions.

More specifically, the present invention provides an aseismic bridge bearing comprising a bridge support bearing provided with a flat surface located on the bearing so that it will be in a substantially horizontal plane when the bearing is operatively mounted in a bridge structure, means for securing the bearing to one of the foundation and the superstructure of a bridge, and an aseismic couple plate provided with means for securing it to the other of the foundation and the superstructure of a bridge, said couple plate being provided with a substantially flat surface cooperable with the support bearing's flat surface to permit relative sliding movement between the two surfaces when the bearing is under load and the bridge is subjected to seismic forces.

The invention also provides a displacement control device for limiting the magnitude of movement between two relatively moveable bodies comprising a first member and a second member, means for securing each of said members to a different one of said bodies, the first member including a shaft, viscoelastic discs slidably mounted on the shaft, the second member being slidably moveable relative to the first member with movement in one direction relative to said first member compressing at least some of said discs.

DESCRIPTION OF PREFERRED EMBODIMENTS OF THE INVENTION

Figure 1:
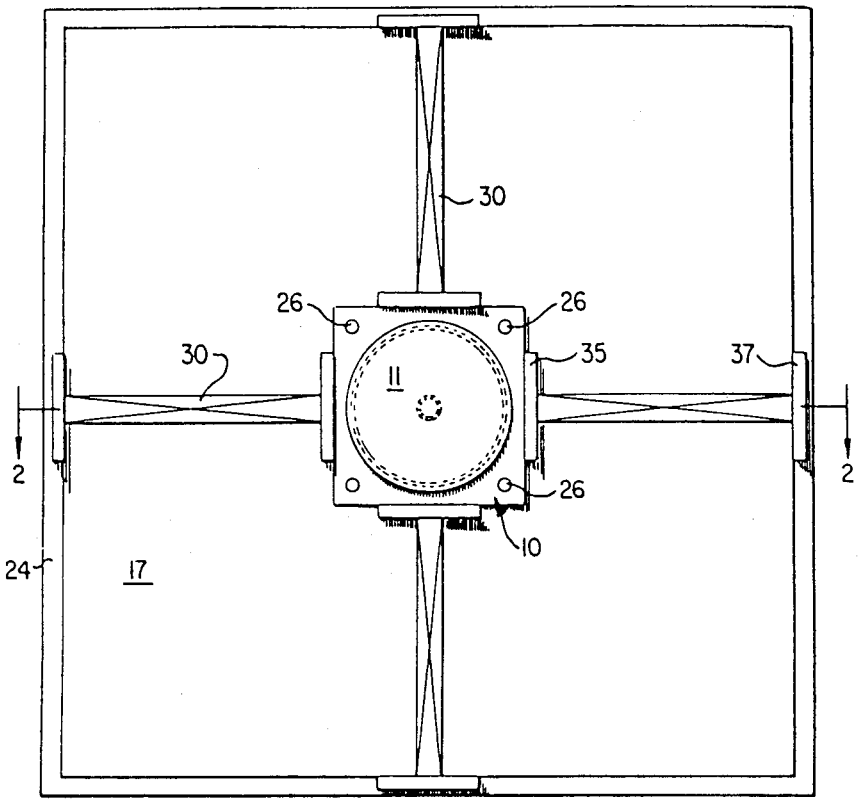
FIG. 1 is a plan view of one preferred embodiment of an aseismic bridge bearing constructed in accordance with the present invention.
Figure 2:
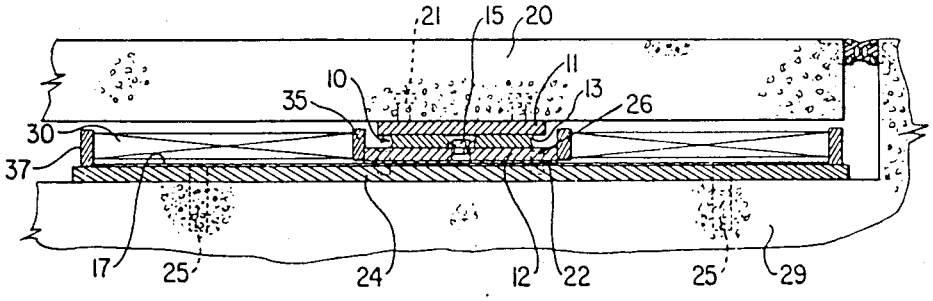
FIG. 2 is a schematic, side view of a section of one end of a bridge, showing a section of the bearing of FIG. 1 taken along the line 2—2 of FIG. 1.

Referring to FIGS. 1 and 2, there is shown a conventional bridge bearing 10 which both supports and guides a bridge's superstructure and which includes, as is known, a top plate 11, a bottom plate 12, and located between the top and bottom plates, a resilient member 13. A locating pin 15 maintains the bearing's components in their proper relative positions during assembly and use.

As best shown in FIG. 2, the bearing 10 is secured to the bridge deck 20 by anchor pins 21 secured to the top plate 11 and extending into concrete forming the bridge deck 20.

In accordance with the present invention the bottom bearing plate 12 is provided on its lowermost surface with a low friction coating preferably consisting of polytetrafluoroethylene (P.T.F.E.) (Teflon—T.M.) applied in a conventinal manner known in the art.

Located beneath the bottom bearing plate 12 is an aseismic couple plate 24 the upper surface of which is formed of a sheet of polished stainless steel 17. The couple plate 24 is secured to the bridge support pier 29 by anchor pins 25. The combination of the polished stainless steel surface 17 on the seismic couple plate 24 and the low friction coating on the bottom of the bearing plate 12 permits relative movement to occur readily between the couple plate 24 and the conventional fixed bearing 10, even under the loading normally experienced by a bridge bearing. Obviously any surfaces having low co-efficients of friction can replace the stainless steel and PTFE surfaces.

In the absence of an earthquake it will normally be desirable to prevent any relative movement from occurring between the bearing 10 and the couple plate 24. This can be achieved by utilizing at least one replaceable fuse pin 26 designed to break in shear when subjected to seismic forces of a predetermined level, and/or two or more energy dissipating, displacement control devices 30. While the fuse pins 26 are intact, the bridge bearing 10 functions in a normal known manner to support and permit normal movement of the bridge to occur. However, when the bridge structure is subjected to seismic forces adequate to shear the fuse pins 26, relative horizontal movement occurs between the couple plate 24 and bearing 10, thereby reducing or eliminating the transmission of the horizontal seismic forces through the foundation to the bridge deck to thereby reduce substantially or eliminate the damage that otherwise would occur to the bridge.

In the embodiment shown in FIGS. 1 and 2, four replaceable fuse pins 26 are utilized to fix the bearing 10 to the seismic couple plate 24 and four displacement control devices 30 are utilized to limit movement of the bearing 10 relative to the seismic couple plate 24 during an earthquake.

Each displacement control device 30, which will be described below, is mounted between a pair of anchor plates, one anchor plate 35 being secured to the bottom bearing plate 12 of the bearing 10 and the other anchor plate 37 being fixed to the seismic couple plate 24.

Figure 9:
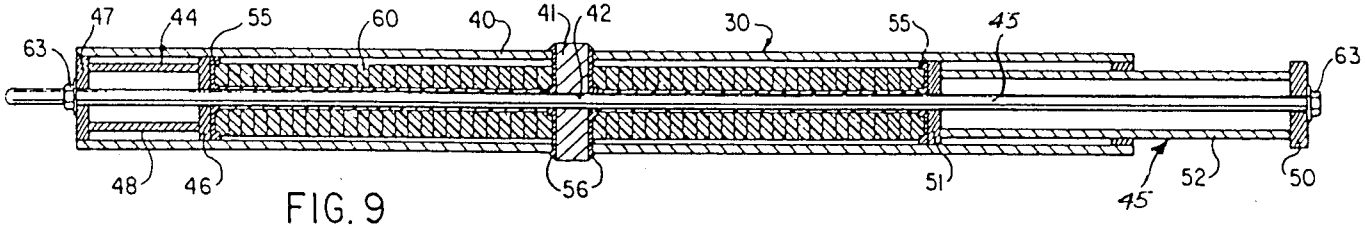
FIG. 9 is a partially sectioned side view of a displacement control device which can be utilized with the bearings of FIGS. 1 and 3.

A preferred form of displacement control device 30 is depicted in FIG. 9. This device includes a casing or shell 40 divided by a partition 41 which is fixed to the casing and which is provided with a centrally located hole 42 through which passes a main shaft 43. Mounted on the main shaft 43 are a pair of hollow cylidrical pistons 44 and 45. Piston 44 includes an inner end 46 and an outer end 47 held in spaced-apart, parallel relationship by cylindrical spacer 48. The inner and outer ends 46 and 47 are circular and sized to permit their sliding movement within the cyclindrical casing 40, the wall of which may be coated with grease or P.T.F.E.

Piston 45 likewise includes an outer end 50, an inner end 51 and a cylindrical spacer 52 which maintains the two ends 50 and 51 in their spaced-apart, parallel relationship with the inner end 51 being sized to permit its sliding movement within the cylindrical casing 40. The inner faces of each of the inner ends 46 and 51 are also provided with sealing rings 55. Sealing rings 56 are also provided on either side of the partition 41.

Sandwiched between the two sets of sealing rings are a plurality of discs 60 each of which is circular and is formed of one or more viscoelastic materials such as Neoprene (TM), Bonafy (TM for a polyether urethane), and other polyurethane elastomers.

Figures 12A, 12B, 12C, 12D:
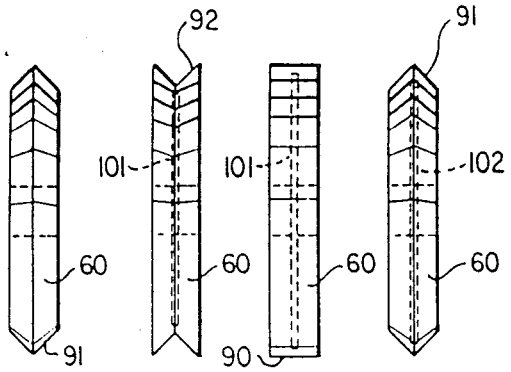
FIGS. 12*a* to 12*g* are edge views of various shapes of viscoelastic discs which can be used in the displacement control devices of FIGS. 9 and 11.
Figures 12E, 12F:
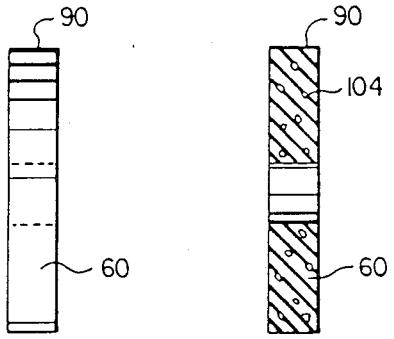
Figures 12G, 13:
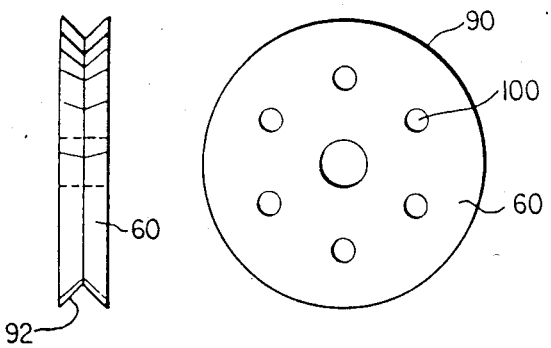
FIG. 13 is a plan view of a viscoelastic disc which can be utilized in the displacement control devices of FIGS. 9 and 13.
Figures 14A, 14B, 14C:
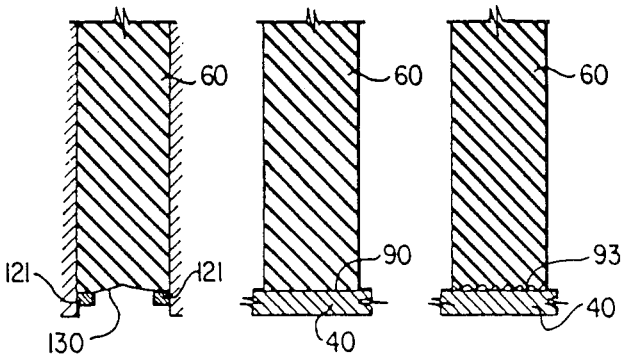
FIGS. 14*a* to 14*c* and 14*e* to 14*j* are partially sectioned edge views of viscoelastic discs having edges of different shapes, and confined by either the displacement control device of FIG. 9 or of FIG. 11.

As shown in FIGS. 12 and 13 the circular discs 60 can have various edge configurations and can include various types of fillers which will be determined by the particular characteristics reqiured for the displacement control device. Specifically, FIG. 12*e* depicts a disc 60 having a square edge 90 adapted to be positioned within the casing 40 with the edge 90 abutting against the inner surface of the casing 40 as shown in FIG. 14*b*. With this configuration, it will be seen that radial expansion of the disc 60, when under compression, is limited greatly by the casing wall 40. Under some circumstances it will be desirable to permit more radial expansion of the disc 60 than is permitted by the configuration of FIG. 14*b* and this can be achieved to varying degrees by varying the geometry or shape of the edge of the disc 60.

Figures 14E, 14F, 14G:
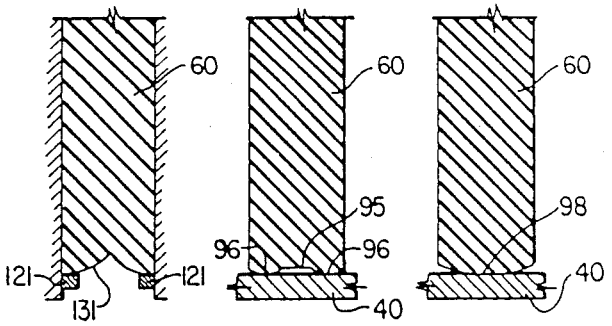
Figures 14H, 14I, 14J:
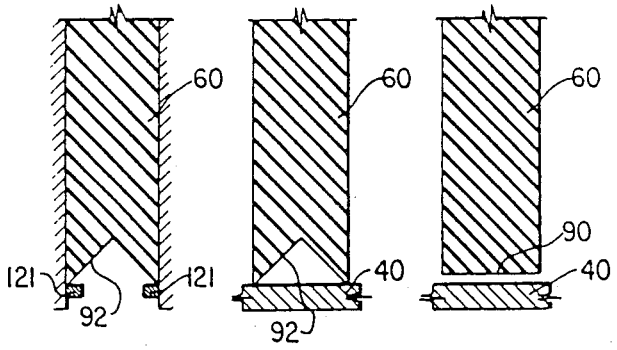

Specifically, in FIG. 12*a*, a V-shaped edge 91 is employed whereas in FIG. 12*g* a V-shaped groove 92 is employed, the V-shaped groove 92 being also depicted in FIG. 14*i* in conjunction with the casing 40. It will be realized that compression of the disc 60 will cause its radial expansion which will be accommodated by the gradual collapse of the V-shaped groove 92. By way of example, various shapes can be used to achieve some control in the compressibility of the disc 60. FIG. 14*c* shows essentially a rounded saw-toothed edge 93 abutting against the casing 40, FIG. 14*f* shows an edge with a central groove 95 to either side of which are located a pair of rounded beads 96, FIG. 14*g* shows a rounded edge 98 in contact with the casing 40. FIG. 14*j* shows a square edged disc 60, that is a disc having the same shape as depicted in FIGS. 12*e* and 14*b* with the difference being that the edge 90 is spaced from the casing 40 to permit greater radial expansion of the disc, when subjected to compression in the displacement control device.

The compressibility of the discs can also be controlled to some extent by providing apertures 100 in the disc 60 as shown in FIG. 13 or, as shown in each of FIGS. 12*b*, 12*c*, 12*d* and 12*f*, various types of fillers can be employed in the discs 60. For example as shown in FIGS. 12*b* and 12*c* steel discs 101 can be employed whereas as shown in FIG. 12*d* a fabric disc shaped filler 102 can be employed. It will be obvious that more than one steel plate or fabric disc can be employed. Also, other types of materials can be employed in lieu of steel and fabric again depending upon the material being utilized to form the viscoelastic disc 60 and the viscoelastic characteristics required of that disc.

As shown in FIG. 12*f*, various shapes of solid particle filler material 104 can also be employed in lieu of the steel and fabric plates and discs.

The discs 60 are maintained in position on the main shaft 43 which can be provided with a low friction coating such as PTFE, by reason of their compression between the pistons 44 and 45 which compression is maintained by the main shaft 43 which functions as a tierod between the two pistons. It will be appreciated that by shortening the distance between the two pistons, the disc 60 can be pre-stressed to any desired degree. This distance between the pistons is fixed by the main shaft 43 to each end of which are secured nuts 63 which can be tightened as necessary to achieve the desired degree of compression of the discs 60.

The device as depicted in FIG. 9 permits relative movement to occur between the assembly consisting of the main shaft and the pistons mounted on it, on the one hand, and the cylindrical casing 40 on the other with the movement being dampened by the viscoelastic discs 60. The degree of dampening is determined by the type of material utilized to form the discs, the composition of the discs and the shape of the discs as well as their density which can be controlled not only by the type of material utilized to form them but also by the drilling of holes into or through each of the discs and by the coatings used on the casing 40 and tie rod drain shaft 43.

The displacement control device 30 can be installed between the anchor plates 35 and 37 in various ways, it being necessary only that the casing 40 be secured to one of the anchor plates and the assembly including the piston 45 be secured to the other to permit relative movement to occur as necessary between the casing and the assembly including the pistons 44 and 45 and main shaft 43. Normally known, preferable hinged connections will be used which can be loaded in tension and compression and will permit articulation, a maximum of 180° in plan and + or −90 degrees vertical in all directions to permit the devices 30 to function properly without binding.

Figure 10:
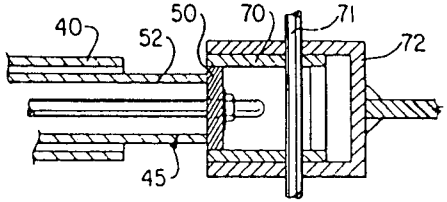
FIG. 10 is a detail of an alternative mounting arrangement for one end of the displacement control device of FIG. 9.

One example of a hinged type of mounting is depicted in FIG. 10 wherein the outer end 50 of the piston 45 has secured to it a rectangular, male member 70 which is pivotally secured by shaft 71 within a female member 72 having a shape complementary to that of the male member 70 thereby providing a hinged connection between the members 70 and 72 to permit their relative movement about the vertical axis defined by the pin 71. The member 72 would in turn be connected to the anchor plate 37 or 35. A similar arrangement can be provided on the other end of the displacement control device to interconnect the cylindrical casing 40 with the other anchor plate 35 or 37 as the case might be and to permit the preferred vertical movement as well.

Figure 3:
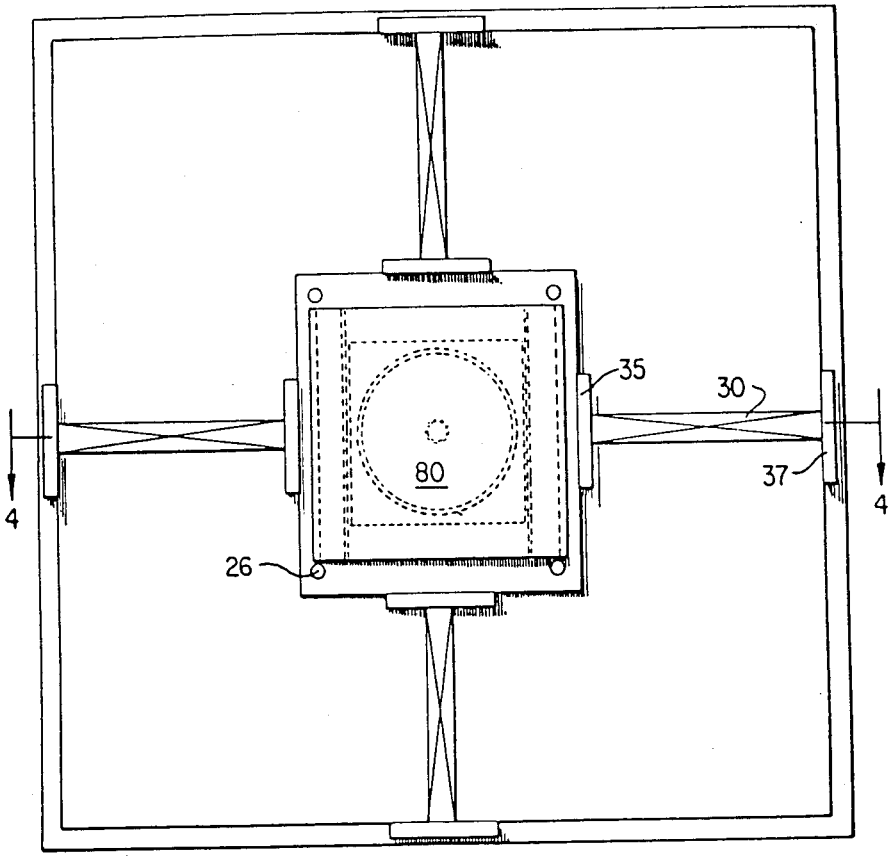
FIG. 3 is a plan view of another preferred embodiment of an aseismic bridge bearing of the present invention.
Figure 4:
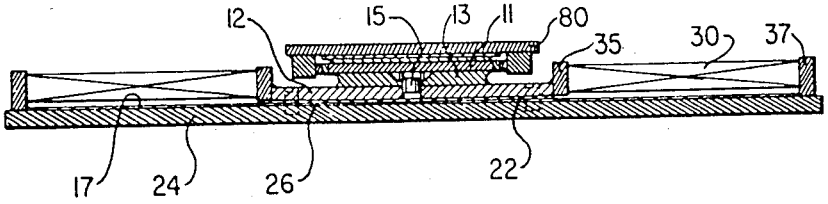
FIG. 4 is a section of the bearing of FIG. 3 taken along the line 4—4 of FIG. 3.

Referring to the embodiment depicted in FIGS. 3 and 4, the arrangement shown in those Figures is essentially the same as that shown in FIGS. 1 and 2 with the exception that the fixed bearing 80 is of a different, although conventional type. This bearing is of the uni-directional type and is known as the Wabbo-Fyfe Uni-directional Bearing manufactured and sold by Elastometal Limited of Burlington, Canada.

Figure 5:
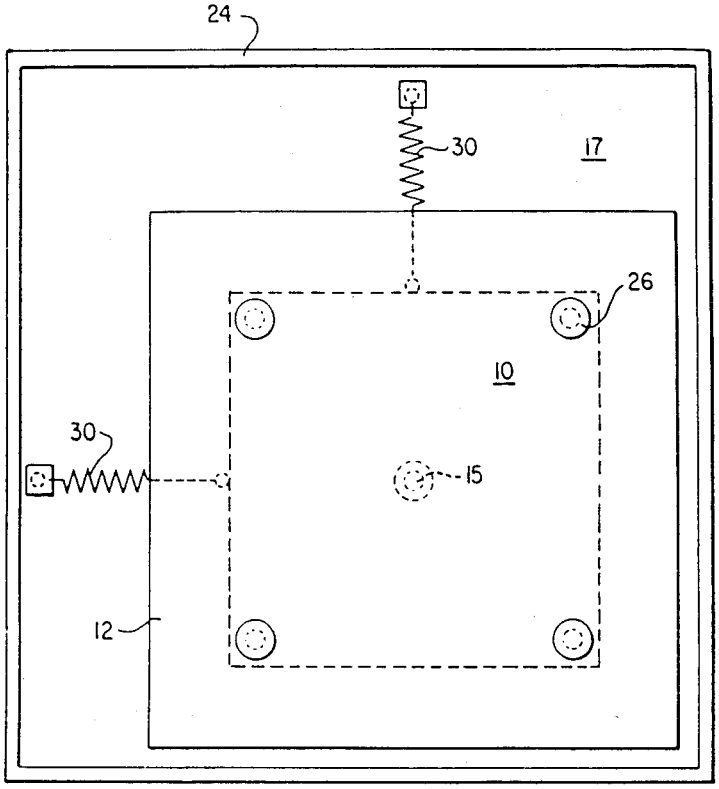
FIG. 5 is a partly schematic plan view of an alternative embodiment of an aseismic bridge bearing in accordance with the present invention.

The displacement control device can operate in compression and/or in tension and as shown in FIGS. 1 and 3 it is preferable to utilize four displacement control devices. However under some circumstances the displacement control devices may be dispensed with. Under other circumstances such as schematically shown in FIG. 5, only two displacement control devices 30 are utilized with each of them operating, under seismic loads, in both tension and compression. FIG. 5 depicts schematically an arrangement which includes a conventional bearing 10 slidedly mounted, exactly as previously described in connection with FIGS. 1 and 2, on a seismic couple plate 24 with the relative movement between the bearing 10 and couple plate 24 being dampened by the pair of displacement control devices 30.

Figure 6:
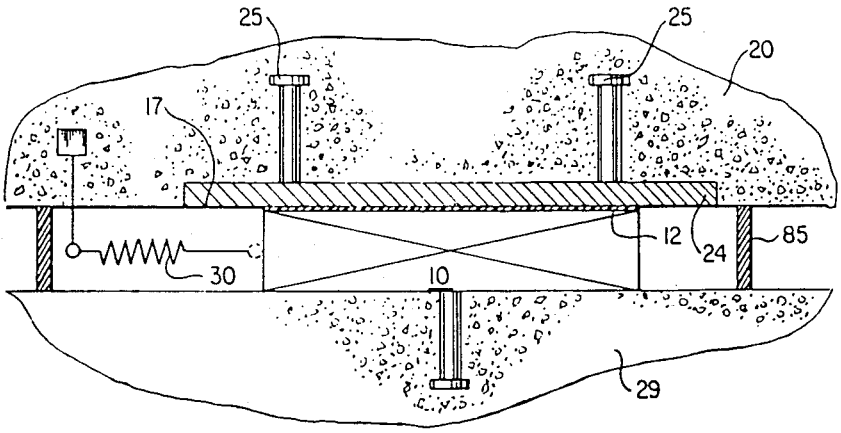
FIG. 6 is a schematic, partially sectioned, side view of the bearing of FIG. 5 mounted in a bridge structure.
Figure 7:
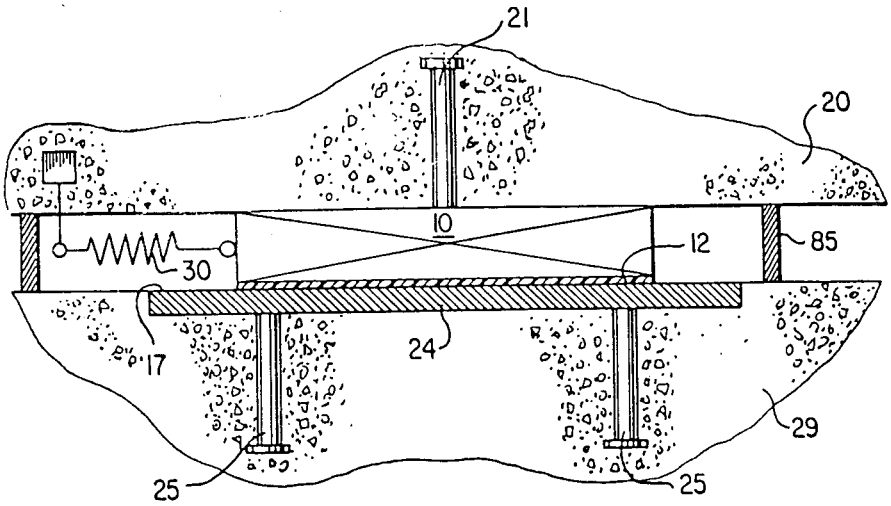
FIG. 7 is a schematic, partially sectioned side view of the bearing of FIG. 5 mounted in a structure in a position which is reversed from that position shown in FIG. 6.

Referring to FIG. 6, this diagram discloses schematically an arrangement wherein the seismic couple plate 24 is top mounted whereas the seismic couple plate 24 in FIG. 7 is bottom mounted. Also shown in each of FIGS. 6 and 7, is a seal 85 shaped to surround completely the bearing 10 of the present invention to exclude dirt, salt and other material normally encountered in the environment of a bridge and which would possibly cause a reduction in the efficacy of the disclosed bearing structure under normal loads as well as seismic loads.

Figure 8:
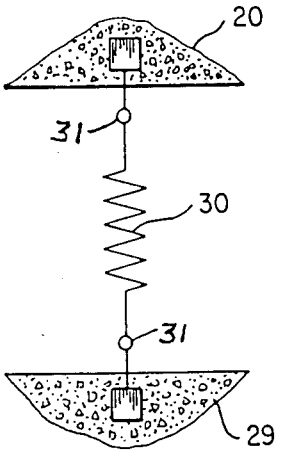
FIG. 8 is a schematic side view of a displacement control device secured vertically between two relatively moveable structures.

While normally the displacement control devices will be installed to dampen and control relative, horizontal movement between the two parts of the structure by up to 50%, the bridge support pier 29 and the bridge deck 20; under some circumstances it will be desirable to include also a displacement control device for dampening and/or reducing relative movement in a vertical direction and this is schematically depicted in FIG. 8 wherein the displacement control device 30 is secured between the deck 20 and the pier 29. In this embodiment articulated hinges 31 are used to permit horizontal displacement to occur as well as vertical without causing misalignment of the central device 30.

Figure 11:
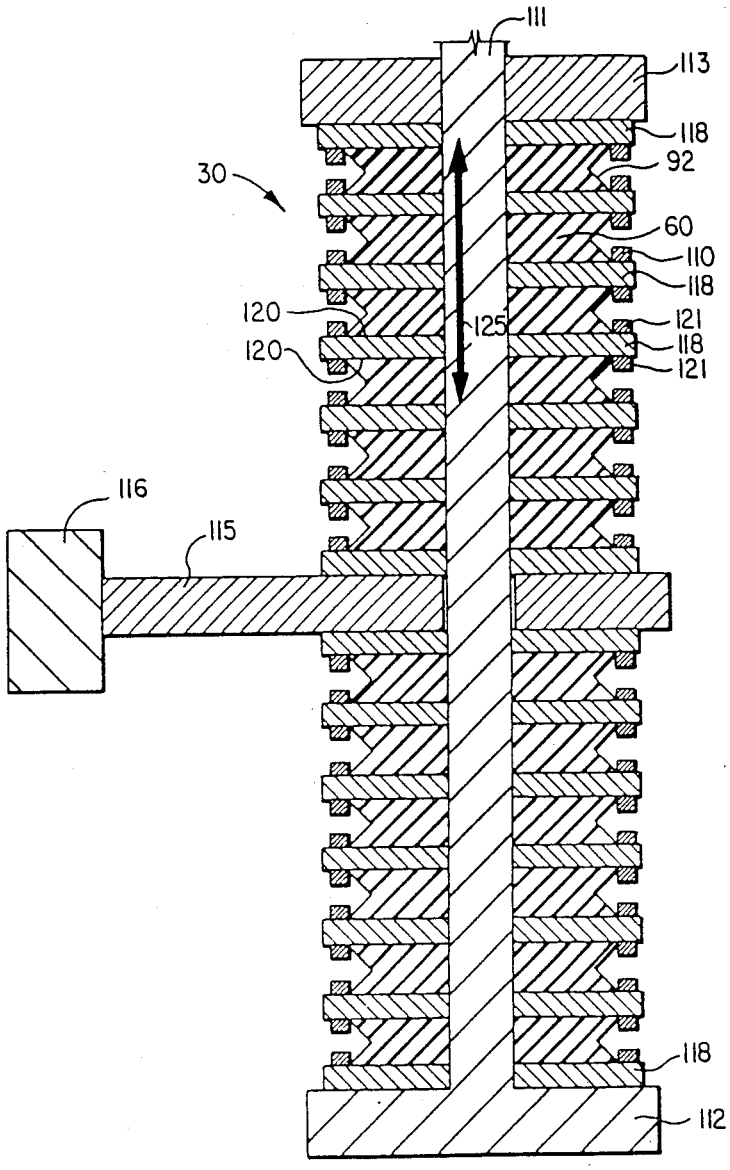
FIG. 11 is a partially sectioned side view of another embodiment of displacement control device which can be utilized with the bearings of FIGS. 1 and 3.

An alternative form of displacement control device 30 is shown in FIG. 11, this device being called a shell-ring disc confining device and being characterized principally by the utilization of limiting rings 110 to restrict the radial expansion of the discs 60 as opposed to the use of a casing. Canadian Pat. No. 1,100,714 issued May 12, 1981, to Elastometal discloses the general concept of a shell ring bearing and its function.

This displacement control device includes a shaft 111 to the lower end of which is fixed an end disc 112 and to the other end of which is adjustably fixed a sliding ring 113 which can be moved longitudinally on the shaft 111 and fixed in a predetermined position for the purpose of preloading the discs 60 retain between the end disc 112 and the sliding ring 113.

Mounted midway on the shaft 111 is an anchor 115 having an enlarged end 116 adapted to be anchored within, or to one part of a bridge or other structure (not shown). Each of the discs 60 is provided with a V-groove 92 as depicted in FIG. 12*g* and located between each of the discs 60 are circular metal plates 118 located parallel to one another and slidably mounted on the shaft 111. Each of the circular discs or plates 118 with the exception of the end most plates, is provided on both of its faces 120 and about their periphery 120 with limiting rings 121 which are fixed to the plates 118.

As mentioned, the anchor 115 is utilized to secure the displacement control device of FIG. 11 to one part of a bridge or other structure and the other relatively movable part of the bridge or other structure whose displacement is to be controlled by the displacement control device has secured to it the shaft 111. The result is that movement between the two relatively movable structures will cause movement of the anchor 15 longitudinally along the shaft 111 in the direction shown by the arrow 125, thereby compressing those discs 60 between the anchor and the end disc 112 or those between the anchor and the sliding ring 113, to the extent permitted by the limiting rings 121 which ultimately will abut against one another when the discs have reached their maximum compression. Therefore the limiting rings 121 mechanically limit the amount of relative movement which can occur between the anchor 115 and the shaft 111 and this movement can be adjusted to some extent by utilizing the sliding ring 113 to precompress the discs 60 when the displacement control device is under a no-load condition and either piror to its installation in the structure or after its installation in the structure by simply moving the sliding ring 113 towards the end disc 112 to precompress the disc 60 or moving the sliding ring 113 away from the end disc 112 to remove compression from the disc 60. With such a structure there can be utilized three internal elastic materials for energy absorption. That is the energy can be absorbed in 3 phases; load deflection during which the discs are compressed without being limited by encountering either the central shaft or the outer shell or ring; limiting or semi confining during which partial contact between the compressed disc and the shaft or shell or ring occur; and totally confining when the disc is fully restrained from further movement in all directions. Obviously, a variance in the parameters of the shapes, sizes and materials of the displacement control devices' components will yield different energy absorbtion characteristics. Stresses will be designed to be within allowable civil engineering codes.

FIG. 14*h* depicts an edge of one of the discs 60 in the displacement control device of FIG. 11, the edge being in the form of a V-groove 92. It will be appreciated that the edge of the disc 60 utilized in the displacement control device of FIG. 11 can be of a geometrical shape other than V-shaped and two examples of alternate shapes are shown in FIGS. 14*a* and 14*e* with FIG. 14*a* depicting a disc 60 having a shallow gull-wing shaped groove 130 and FIG. 14 showing a deeper gull-wing shaped groove 131 about the periphery of the disc 60. Other shapes can also be utilized depending again upon the characteristics desired for the displacement control device.

There has thus been disclosed aseismic bearings particularly for bridges in which the foundation must support a superstructure which is required to be normally, relatively movable with respect to its foundation under various atmospheric conditions and there has also been disclosed various forms of displacement control devices for controlling the maximum relative displacement between a foundation and a superstructure during an earthquake. It will be appreciated that the preferred seismic bearings and displacement control devices which have been disclosed are capable of modification without departing from the scope of the present invention, to accommodate the specific requirements of the many various types of bridge structures which are to be protected from seismic forces while at the same time permitting some relative movement to occur between the structure's support or foundation and its superstructure.

We claim:

1. An aseismic bridge bearing comprising:

a first plate, a second plate, a resilient member sandwiched between the first and second plates to permit vertical and horizontal movement between the first and second plates, and a locating pin between the resilient member and one of the first and second plates;

an aseismic couple plate secured by first anchor pins to one of a bridge pier and a bridge deck, the first plate being secured to the other of the bridge pier and bridge deck and the second plate being adjacent and parallel to the couple plate; and a fuse pin between the second plate and the couple plate such that during normal operating conditions movement between the bridge deck and bridge pier will be accommodated by the resilient member; however, during seismic activity excessive horizontal displacement will cause rupturing of the fuse pin and permit sliding to occur between the second plate and the couple plate.

2. The bearing of claim 1, wherein the first plate is the top plate and the second plate is the bottom plate.

3. The bearing of claim 1, including a stainless steel laminate upon the face of the couple plate which is adjacent to the second plate.

4. The bearing of claim 1, wherein the first plate is secured by second anchor pins.

5. The bearing of claim 1, including a displacement control device between the second plate and the couple plate for limiting the magnitude of movement between the second plate and the couple plate.

6. The bearing of claim 5, including anchor plates secured to the second plate and the couple plate between which the displacement control device is located.

7. The bearing of claim 5, including an articulated hinge between the displacement control device and the second plate and the displacement control device and the couple plate.

8. An aseismic bridge bearing comprising:

a first plate, a second plate, and a resilient member sandwiched between the first and second plates;

an aseismic couple plate secured by first anchor pins to one of a bridge pier and a bridge deck, the first plate being secured to the other of the bridge pier and bridge deck;

the second plate being adjacent and parallel to the couple plate;

a displacement control device between the second plate and the couple plate for limiting the magnitude of movement between the second plate and the couple plate, wherein the displacement control device consists of a first member and a second member each secured to a respective anchor plate, the first member including a shaft and a plate at each end of the shaft, a row of viscoelastic discs slideably mounted upon the shaft and the second member including an annular disc which is slideable along the shaft relative to the first member with movement in one direction relative to the first rember causing compression of at least some of the viscoelastic discs; and a fuse pin between the second plate and the couple plate, such that during normal operating conditions, movement between the bridge deck and the bridge pier will be accommodated by the resilient member, but during seismic activity excessive horizontal displacement will cause rupturing of the fuse pin and permit sliding to occur between the second plate and the couple plate.

9. The bearing of claim 8, wherein the annular disc is situated at the central region of the row of viscoelastic discs.

10. The bearing of claim 9, wherein the second member includes a cylinder extending from each side of the annular disc and the plate at each end of the shaft is sized to be able to slide within the cylinder in the manner of a piston.

11. The bearing of claim 10, wherein each piston has an inwardly extending cylindrical extension and a second piston at the inner end of each extension, each second piston forming a reciprocating seal with the cylinder to prevent egress of dirt and moisture into the regions of the cylinder wherein the viscoelastic discs are contained.

* * * * *